United States Patent [19]

Hakkarainen et al.

[11] Patent Number: 4,985,084

[45] Date of Patent: Jan. 15, 1991

[54] TWO-LAYER PAPER MACHINE FABRIC

[75] Inventors: Merja Hakkarainen, Juankoski; Seppo Taipale, Siilinjärvi, both of Finland

[73] Assignee: Tamfelt Oy Ab, Tampere, Finland

[21] Appl. No.: 550,010

[22] Filed: Jul. 9, 1990

[30] Foreign Application Priority Data

Jun. 15, 1990 [FI] Finland ..... 903024

[51] Int. Cl.[5] ..... D03D 23/00

[52] U.S. Cl. ..... 139/383 A; 162/DIG. 1; 162/358; 428/225; 428/257

[58] Field of Search ..... 139/383 A; 162/358, 162/DIG. 1; 428/225, 257

[56] References Cited

U.S. PATENT DOCUMENTS

| | | | |
|---|---|---|---|
| 4,640,741 | 2/1987 | Tsuneo | 428/225 |
| 4,642,261 | 2/1987 | Fearnhead | 428/225 |
| 4,821,780 | 4/1989 | Tate | 428/225 |

FOREIGN PATENT DOCUMENTS

| | | |
|---|---|---|
| 60258 | 1/1977 | Finland . |
| 822731 | 8/1982 | Finland . |
| 72164 | 12/1982 | Finland . |

*Primary Examiner*—James J. Bell

*Attorney, Agent, or Firm*—Lowe, Price, LeBlanc, Becker & Shur

[57] ABSTRACT

A two-layer paper machine fabric comprising one machine direction yarn system and two cross-machine direction yarn systems. The yarn systems are interlaced in accordance with an 8-shaft weave repeat. The yarns of the cross-machine direction yarn systems are positioned in two layers in such a way that the number of yarns in the upper system is double as compared with the lower cross-machine direction yarn system. To achieve a stable fabric each machine direction yarn passes during one weave repeat over two yarns in the upper cross-machine direction yarn layer and under one yarn in the lower cross-machine direction yarn layer. The passage of each machine direction yarn is reverse as compared with the passages of adjacent yarns. The yarns of the upper cross-machine direction yarn system form floats extending alternately over two and four machine direction yarns and the yarns of the lower cross-machine direction yarn system form floats extending alternately over two and four machine direction yarns. The longer float of the upper cross-machine direction yarn is always in alignment with the shorter float of the lower cross-machine direction yarn, and vice versa.

2 Claims, 1 Drawing Sheet

FIG. 1
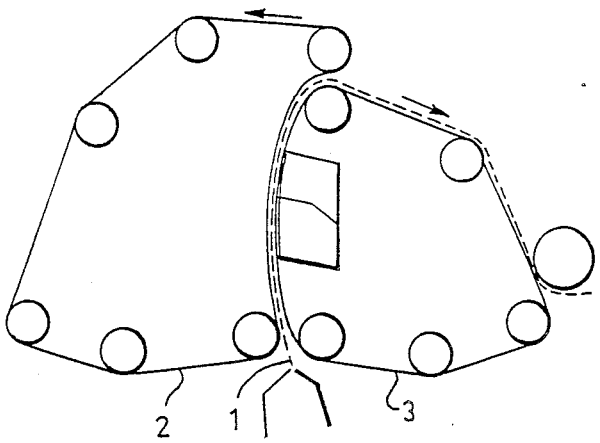
FIG. 5
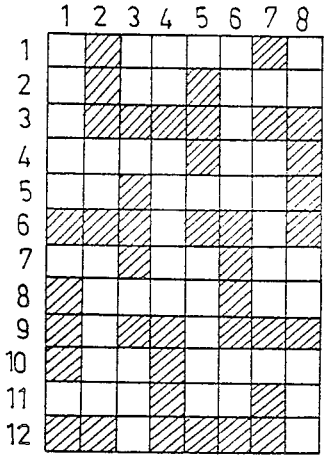
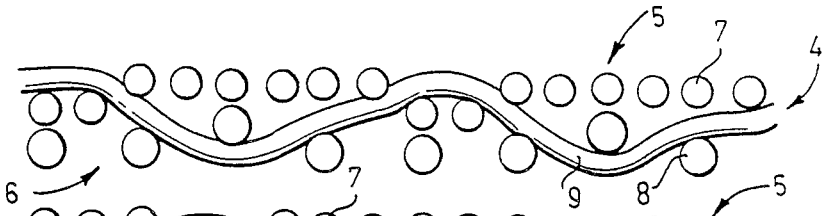
FIG. 2
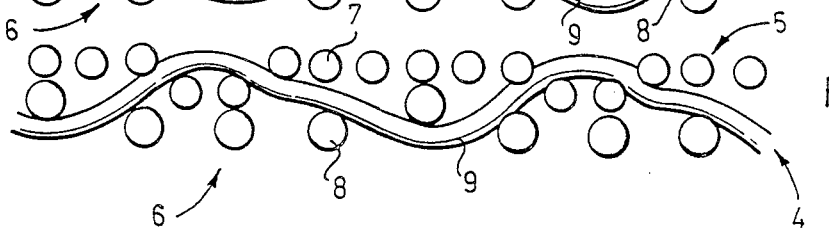
FIG. 3
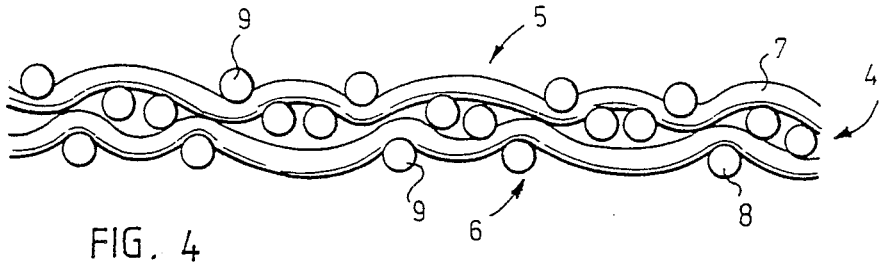
FIG. 4

TWO-LAYER PAPER MACHINE FABRIC

The invention relates to a two-layer paper machine fabric comprising one machine direction yarn system and two cross-machine direction yarn systems of which the upper cross-machine direction yarn system is positioned on the paper contacting side of the fabric and the lower cross-machine direction yarn system on the machine contacting side of the fabric, all the yarn systems being interlaced in accordance with an 8-shaft weave repeat, and the yarns of the cross-machine direction yarn systems being positioned in two layers in such a way that the number of yarns in the upper system is double as compared with the lower cross-machine direction yarn system.

This kind of paper machine fabrics are today well-known and they are intended mainly for paper machines producing newsprint in which paper pulp is injected into a gap between two wires. In machines of this type the wires have to be extremely steady as the wires are not supported in any way on the back side at points where the injection pulp is directed. In addition, the wires are short, so that the removal of water has to be carried out rapidly.

One example of prior art paper machine fabrics is the solution disclosed in FI Patent application No. 770291. In this solution, however, the number of the extensions of the machine-direction yarns on the outside of the wire is minimized, so that the yarns of the two cross-machine direction yarn systems form long floats on both surfaces of the wire. In such a wire both the forming side and the wear side mainly consist of cross-machine direction yarns. When the machine-direction yarn system binds both cross-machine direction yarn systems as seldom as possible, in practice only once during one repeat, this kind of fabric is unstable, that is, the fabric is sensitive to deviations caused by diagonal forces. In practice, this causes the wire to become narrower in the paper machine. This tendency can be easily seen even from a small piece of fabric by holding it from two opposite corners and by drawing in opposite directions. If the piece of fabric can be easily drawn into the shape of a parallelogram, it can be assumed that the dimensional stability of the wire may cause problems during the run of the paper machine.

Another example is the three-layer forming fabric disclosed in FI Patent application No. 822731. The design of this fabric aims mainly at improving rigidity in cross-machine direction. The crossmachine direction yarns are positioned on top of each other in three layers and they are bound together by a single machine direction yarn system. A problem with this kind of fabric is that the machine direction yarn passes from the outer surface of the fabric to the other surface at a very wide angle. When the fabric is used in a paper machine, the cross-machine direction yarn layers easily get into an oblique position relative to the transverse direction while the machine direction yarns get closer to each other so that the width of the wire is decreased. The high transverse rigidity of the wire is of no importance as the wire nevertheless lack rigidity.

Still another example is the two-layer paper forming fabric disclosed in FI Published Specification No. 72164, in which the paper contacting side is formed by two types of yarns. The number of yarns on the machine contacting side is half the number of yarns on the paper contacting side. There are two types of yarns on the paper contacting side: yarns belonging to the basic fabric and so-called additional yarns. The additional yarns do not really belong to the basic fabric: they can be omitted and the fabric texture is nevertheless complete. The additional yarns are also of a smaller diameter than the yarns of the basic fabric. By virtue of the use of additional yarns the density of the cross-machine direction yarns on the paper contacting side is greater than the density of the cross-machine direction yarns on the machine contacting side, whereby the purpose has been to improve the wire supporting properties of the wire. A problem, however, is that the cross-machine direction steadiness or rigidity of the fabric is not substantially improved when using yarns which do not essentially belong to the basic texture but pass in the surface of the fabric without being properly interlaced with the machine direction yarns. It has also been found that a fabric comprising additional yarns easily yields when it is stretched at an angle of 45° with respect to the machine direction.

The object of the invention is to provide a paper machine fabric by means of which the drawbacks of the prior art can be eliminated. This is achieved by means of the paper machine fabric of the invention which is characterized in that each machine direction yarn passes during one weave repeat over two yarns in the upper cross-machine direction yarn layer and under one yarn in the lower cross-machine direction yarn layer, that the passage of each machine direction yarn is reverse as compared with the passages of adjacent yarns, that the yarns of the upper cross-machine direction yarn system form floats extending alternately over two and four machine direction yarns on the paper contacting side of the fabric and that the yarns of the lower cross-machine direction yarn system form floats extending alternately over two and four machine direction yarns on the machine contacting side of the fabric in such a way that the longer float of the upper crossmachine direction yarn is always in alignment with the shorter float of the lower cross-machine direction yarn, and vice versa.

An advantage of the invention over prior art solutions is that the texture of the fabric is so stable that its dimensions do not substantially change in the machine. A further advantage of the fabric of the invention is that the fibres on the paper contacting side are properly supported and that the permeability of the fabric is extremely high as compared with prior art solutions. These matters are of vital importance particularly in paper machines in which paper pulp is injected into a gap between two wires.

In the following the invention will be described by means of one preferred embodiment shown in the attached drawing, wherein FIG. 1 is a general side view of a simplified example of paper machine types in which the paper machine fabric of the invention is to be used;

FIG. 2 is a sectional view of the paper machine fabric of the invention seen in the crossmachine direction;

FIG. 3 shows the fabric of FIG. 2 in the same direction as in FIG. 2 but at a different warp yarn;

FIG. 4 is a sectional view of the paper machine fabric of the invention seen in the machine direction; and FIG. 5 shows the weave pattern of the paper machine fabric of the invention.

FIG. 1 is a general view of a paper machine in which paper pulp 1 is injected from below upwards into a gap formed by two wires 2 and 3. The paper machine fabric of the invention is intended to be used preferably as the wires 2, 3 of this particular type of paper machine.

FIGS. 2 to 5 show the paper machine fabric of the invention, comprising one machine direction yarn system 4 and two cross-machine direction yarn systems 5, 6. The upper cross-machine direction yarn system 5 is positioned on the paper contacting side of the fabric, that is, on the side to be contacted with the paper pulp, while the lower yarn system 6 is positioned on the machine contacting side making contact with the rolls of the paper machine, for instance. The yarn systems 4 to 6 are interlaced in accordance with an 8-shaft weave repeat. Yarns 7, 8 in the cross-machine direction yarn systems 5, 6 are positioned in two layers in such a way that the number of yarns 7 in the upper system 5 is double as compared with the number of yarns 8 in the lower system 6. In the figures, the yarns of the machine direction yarn system 4 are indicated with the reference numeral 9.

As is shown in the figures, reinforced satin comprising evenly distributed relatively short floats of machine direction and cross-machine direction yarns has proved suitable for use as a surface texture in the paper machine fabric of the invention. During one repeat each machine direction yarn 9 passes over two yarns 7 in the upper cross-machine direction yarn layer 5, i.e. on the paper contacting side, before it passes between the cross-machine direction yarn layers 5 and 6 and further to the machine contacting side. On the machine contacting side the machine direction yarn 9 passes during one repeat under one cross-machine yarn 8 at a time before it returns between the layers 5, 6 and further to the surface on the paper contacting side. In the machine direction yarn system 4 the yarns 9 are arranged in such a way that the passage of each machine direction yarn 9 is reverse as compared with adjacent yarns 9. The machine direction yarn system 4 is formed by yarns 9 interlaced in two different ways. The repeat of the yarns 9 is similar but reversed, that is, the yarns pass in a reverse manner as compared with each other. The yarns 9 are so positioned that the passage of two adjacent yarns is always reversed. This matter appears particularly clearly from FIGS. 2 and 3, which show the passage of two adjacent machine direction yarns 9. FIGS. 2 and 3 show the passage of the fifth and the sixth machine direction yarn in the weave pattern of FIG. 5.

The yarns 7 of the upper cross-machine direction yarn system 5 form floats extending alternately over two and four machine direction yarns 9 on the paper contacting side while the yarns 8 of the lower cross-machine direction yarn system 6 form floats extending alternately over two and four machine direction yarns 9 on the machine contacting side of the fabric. These cross-machine direction yarns 7, 8 are so positioned that the longer float of the upper cross-machine direction yarn 7 is always in alignment with the shorter float of the lower crossmachine direction yarn 8 and vice versa. These matters appear particularly clearly from FIG. 4.

The yarns 7 of the upper cross-machine direction yarn system 5 are preferably thinner than the yarns 8 of the lower cross-machine direction yarn system 6.

The repeat of the fabric of the invention is shorter than with a so-called multi-layer fabric, of which the texture described in FI Patent application No. 822731 is one example. The machine direction yarn 9 thereby has to rise and descend at a sharper angle when passing between the upper and lower surfaces of the fabric. This makes the fabric more stable as compared with the multi-layer fabric, in which the machine direction yarns pass at a very wide angle via three or more cross-machine yarn layers between the surface and the bottom of the fabric.

The two-layer texture of the invention is also advantageous in view of seaming. Since the crossdirection yarns are only in two layers, it is possible to form the seam within a broader area than in a wire of multi-layer texture. An endless fabric is formed by weaving the ends of the fabric together in accordance with the same weave repeat as elsewhere in the fabric. The cross-machine direction yarns of the fabric are thereby used as warps and the machine direction yarns as wefts, whereas the fabric itself is prepared by the weaving machine in such a manner that the longitudinal direction of the wire is formed by warp yarns and the transverse direction by the weft yarns. The warp number of a seam fabric is usually limited, that is, only a certain number of the yarns of the fabric can be passed into the seam area. The greater the number of layers in which the cross-machine direction yarns are positioned, the narrower the resulting seam. The durability of the wire in a paper machine also depends on the strength of the seam. For the strength of the seam it is of great importance that the joints of the machine direction yarns of the wire are firm so that they will not slip. The broader the seam can be made, the greater the number of knuckles, that is, loops over an upper yarn or under a lower yarn formed by the machine direction yarns within the area of the seam, and the greater the friction exerted on the machine direction yarn, whereby the joints resist a greater force without slipping, that is, resist a greater tightness in the paper machine.

Sensitivity to distortion is also affected by the degree and sharpness of the winding of the machine direction yarn. If the machine direction yarns wind gently in the fabric, distortion is very liable to occur in the paper machine. If the machine direction yarns wind sharply and are in contact with the cross-machine direction yarns at several points, the texture of the fabric is stable.

The embodiment described above is by no means intended to restrict the invention, but the invention can be modified within the scope of the claims as desired. For instance, the yarn thicknesses are in no way restricted to any determined values. In one preferred embodiment, the thickness of the machine direction yarn was 0.17 mm, the thickness of the upper cross-machine direction yarn 0.20 mm and the thickness of the lower cross-machine direction yarn 0.25 mm. This, however, is not the only alternative but other yarn thicknesses can be used as well. The yarns of the upper cross-machine direction yarn system may also be equally thick, or in some cases they may be even thicker than the yarns of the lower cross-machine direction yarn system, etc. In view of good paper forming properties, the density of the cross-machine direction yarns in the surface is possible to set so that the air permeability will be at least 500 CFM. Water permeability would be a more proper parameter to describe the performance of a paper machine fabric in a paper machine. As compared with water permeability measurements, however, air permeability measurement is simpler to carry out and does not require cutting of a sample. As there exists a marked correspondence between air and water permeabilities, air permeability measurements are often used in place of water permeability measurements. The unit CFM is widely used in the art to describe air permeability; it indicates how many cubic feet of air passes through the fabric in one minute within an area of one square foot with a pressure difference of 1.25 mbar. The manufacturing material of the paper machine fabric of the invention is not either limited in any way, but the yarns can be of any suitable material, such as polyester and polyamide. It is also possible to manufacture all the yarns of the same material or alternatively some yarns of one material and the other of another material. For instance, the yarns of the lower cross-machine direction yarn or some of them may be made of a different material than the other yarns, etc.

I claim:

1. A two-layer paper machine fabric comprising one machine direction yarn system and two crossmachine direction yarn systems of which the upper cross-machine direction yarn system is positioned on the paper contacting side of the fabric and the lower cross-machine direction yarn system on the machine contacting side of the fabric, all the yarn systems being interlaced in accordance with an 8-shaft weave repeat, and the yarns of the cross-machine direction yarn systems being positioned in two layers in such a way that the number of yarns in the upper system is double as compared with the lower cross-machine direction yarn system, whereby each machine direction yarn passes during one weave repeat over two yarns in the upper cross-machine direction yarn layer and under one yarn in the lower cross-machine direction yarn layer, and the passage of each machine direction yarn being reverse as compared with the passages of adjacent yarns; the yarns of the upper cross-machine direction yarn system form floats extending alternately over two and four machine direction yarns on the paper contacting side of the fabric and the yarns of the lower cross-machine direction yarn system form floats extending alternately over two and four machine direction yarns on the machine contacting side of the fabric in such a way that the longer float of the upper cross-machine direction yarn is always in alignment with the shorter float of the lower cross-machine direction yarn, and vice versa.

2. A paper machine fabric according to claim 1, wherein the yarns of the upper machine direction yarn system are thinner than the yarns of the lower cross-machine direction yarn system.

* * * * *